US005351887A

United States Patent [19]

Heterington et al.

[11] Patent Number: 5,351,887

[45] Date of Patent: Oct. 4, 1994

[54] PUMPING AND SPRAYING SYSTEM FOR HEAVY MATERIALS

[75] Inventors: Robert D. Heterington; James E. Cavanaugh, both of Sunland; Gary D. Cavanaugh, Bakersfield, all of Calif.

[73] Assignee: Binks Manufacturing Company, Franklin Park, Ill.

[21] Appl. No.: 19,161

[22] Filed: Feb. 16, 1993

[51] Int. Cl.[5] ..... B05B 9/00

[52] U.S. Cl. ..... 239/125; 239/124

[58] Field of Search ..... 239/124, 125, 127

[56] References Cited

U.S. PATENT DOCUMENTS

| | | | |
|---|---|---|---|
| 2,488,089 | 11/1949 | Mayo | 239/125 |
| 2,991,940 | 7/1961 | Dupler et al. | 239/125 |
| 3,458,133 | 7/1969 | Wiggins | 239/124 |
| 5,040,732 | 8/1991 | Anderson et al. | 239/124 |

FOREIGN PATENT DOCUMENTS

| | | | |
|---|---|---|---|
| 1310032 | 5/1987 | U.S.S.R. | 239/124 |

*Primary Examiner*—Karen B. Merritt
*Attorney, Agent, or Firm*—David O'Reilly

[57] ABSTRACT

A pumping and spraying system for heavy filled viscous primary fluid material comprised of a pump for such materials that will pump the primary fluid without cavitation and a plural component spray gun that will spray the material on demand and automatically divert the heavy filled primary fluid material back to a supply source when a trigger is released. The plural component spray gun is provided with generous size primary fluid conduit passageways through a chamber having a primary fluid valve which controls the flow of the primary fluid to a spray nozzle for delivery with a secondary fluid. An open diversion conduit connected perpendicular to the chamber has smaller passageways that divert the primary fluid back to the supply source whenever the primary fluid valve is closed to control and prevent static back pressure. This permits spraying of a heavy filled viscous primary fluid on demand without separation of the fluid components (i.e. packing-out), or clogging of fluid passageways or the spraying tip.

28 Claims, 3 Drawing Sheets

PUMPING AND SPRAYING SYSTEM FOR HEAVY MATERIALS

FIELD OF THE INVENTION

This invention relates to systems for delivering heavily filled materials such as fluids filled with granular material and more particularly relates to a pumping and spraying system therefor.

BACKGROUND OF THE INVENTION

Heavy filled material such as fluids filled with granules to simulate granite or marble surfaces are used for coating various products. However a problem with these materials is delivering them to the product to be coated. There are pumps which will pump such materials but applying them to the product is difficult because attempts to spray the materials cause "packing-out." Packing-out is the phenomenon of the heavy components in the materials separating when the material is under static back pressure that can cause clogging of passageways stopping the flow. Typically the loading ratio of these heavy filled fluid materials is 45% solids or granules to 55% fluid or greater.

Presently there are no efficient spraying devices for applying such heavy filled materials. Most methods of applying such materials are by pouring or some other method of manually applying the material to a surface. However this type of application is inefficient and not completely satisfactory as the finished surfaces can be uneven and unattractive. When using heavy filled materials to simulate marbling type surfaces the user desires to provide a smooth non-abrasive surface. The present methods of applying these products make producing such surfaces difficult.

It is one object of the invention to provide a plural component spray gun for a heavy filled primary fluid material that automatically recirculates the primary fluid to control and minimize static back pressure to prevent clogging of the spray nozzle and passageways.

It is also an object of the present invention to provide a pumping and plural component spray system which can efficiently deliver heavy filled fluid materials.

Yet another object of the present invention is to provide a pumping and spraying system that can deliver heavy filled materials at relatively low pressures.

Still another object of the present invention is to provide a pumping and spraying system that prevents the material from "packing-out" and clogging the equipment.

Still another object of the present invention is to provide a system for pumping and spraying heavy filled materials that has an automatic recirculation mode at the gun nozzle that keeps the material moving to prevent clogging of fluid passageways in the spray gun.

Still another object of the present invention is to provide a pumping and spraying system for heavy filled materials that employs a divergent conduit to prevent static pressure and keep heavy filled material moving.

Yet another object of the present invention is to provide a pumping and spraying system that supplies heavy filled primary fluid material on demand without any lead or lag times between the primary and secondary fluids.

Yet another object is to provide a pump and spraying system for granite effect gel coat material or the like in which the resin is heavily loaded and the particles are large.

BRIEF DESCRIPTION OF THE INVENTION

The purpose of the present invention is to provide a pumping and spraying system for spraying heavy filled materials such as granite effect gel coat material and other extremely viscous fluent materials, The spray system utilizes a spray gun similar to that disclosed and described in U.S. Pat. No. 4,175,702 issued Nov. 27, 1979 incorporated herein by reference. The spray gun is comprised of a uniquely designed nozzle body attached to a handle body that is designed to spray the granular or other highly viscous material through a spray tip. The nozzle gun body has been designed with a new generously large primary fluid inlet conduit in a front section leading directly to a chamber having the primary fluid control valve and having an opening to a spraying nozzle- Smaller diversion conduit passageways perpendicular to the primary valve chamber are used as a return line to divert the granular or heavy viscous material back to the source.

When the spray gun trigger is operated a pump shifts from a bypass mode with the heavy viscous material recirculating, to a demand mode to spray material from the nozzle tip. Release of the trigger returns the pump back to a slower bypass mode with the heavy viscous material continually recirculating because of the smaller passageways of the diversion system. The primary fluid or resin conduit passageways are substantially larger than the diversion conduit so that when the trigger is pulled the material is sprayed from the nozzle on demand. Thus pulling the trigger causes an automatic change from a recirculation mode to a demand mode and the heavy filled viscous material is sprayed from the tip. Release of the trigger diverts the heavy viscous material into the smaller diversion conduit for return back to the source.

Surprisingly the diversion conduit can remain open to the primary valve chamber throughout operation. Only the main passageway is open and closed by the primary fluid valve. This effectively controls and prevents any static back pressure that could cause clogging of the plural component spray gun passageways and nozzle tip. Recirculation pumps are known but they involve switches, valves and controls. Also they would still cause static pressure in the gun passageways that will cause "packing out" and clogging. With the present invention the diversion and recirculation is accomplished without any moving parts.

The diversion conduit system must be smaller than the primary fluid conduit delivery system but should be large enough to control and prevent static back pressure. The exact size will depend upon the viscosity and loading of the heavy filled fluid material. Opening the primary fluid valve causes the heavy filled viscous material to be sprayed from the nozzle tip. Close the primary fluid valve and the heavy filled viscous fluid material is automatically diverted, for recirculation to the source.

Diverting the material through the diversion conduit prevents the heavy filled viscous material from being subjected to static back pressures which frequently cause clogging (i.e. packing-out). Packing-out is the separation of solids or granular material from the fluid or resin. Thus the heavy filled viscous material is constantly conveyed or supplied only by dynamic pressures preventing "pack-out" or clogging of the gun tip or passageways. Another advantage of the system is that the recirculation mode with the heavy viscous material continuously circulating through the gun back to the source is effective in keeping the particles (granules) in suspension. A further advantage is that spraying of this material can be performed at about 10 psi spray nozzle air pressure at the gun nozzle allowing the gun to comply with strict pollution rules.

Preferably the system employs the dual pumping system disclosed and described in U.S. Pat. No. 5,094,596 issued Mar. 10, 1992 and incorporated herein by reference. A pump typically having a 3-1 pumping ratio provides ample suction to lift a heavy filled material such as a granite effect gel coat resin column of fluid yet allows the dynamic pressure to be restricted to a 300 psi if desired. The pump continues to operate whether the trigger is on or off. When the trigger is on, the pump shifts from a bypass mode to a demand mode to spray material from the nozzle tip. When the trigger is released the heavy resin material is diverted back through a return line to the source preventing any static pressures and clogging of the gun. While the pump of the aforementioned patent is preferred any pump that can pump heavy filled viscous materials without cavitation would be suitable.

Pump hose lengths from the source and gun hose lengths are preferably kept short to facilitate movement of the heavy viscous material. For this reason a pump similar to that shown and described in U.S. Pat. No. 4,690,308 directly mounted on a pail or reservoir would be preferred. Recirculation would be provided by an additional port in the pail cover.

The spray gun disclosed and described is particularly suitable for use with granite effect gel coat materials that incorporate granules in a resin to be combined with a catalyst and sprayed on a surface. The diverting method of the spray gun body can also be used to spray other heavy viscous material such as formulations including micro balloons, hollow glass spheres (both of which are very fragile), which could be conveyed and sprayed with less injury to them. Other materials that can be sprayed would include syntactic foams, polymorphic resins, synthetic gypsum and a host of other formulations. Materials that can be pumped without cavitation by the dual pumping system of the patent referred to hereinabove should be able to be sprayed with the design of the spray gun disclosed herein.

The above and other features of this invention will be fully understood from the following detailed description and the accompanying drawings, in which:

DETAILED DESCRIPTION OF THE INVENTION

Figure 1:
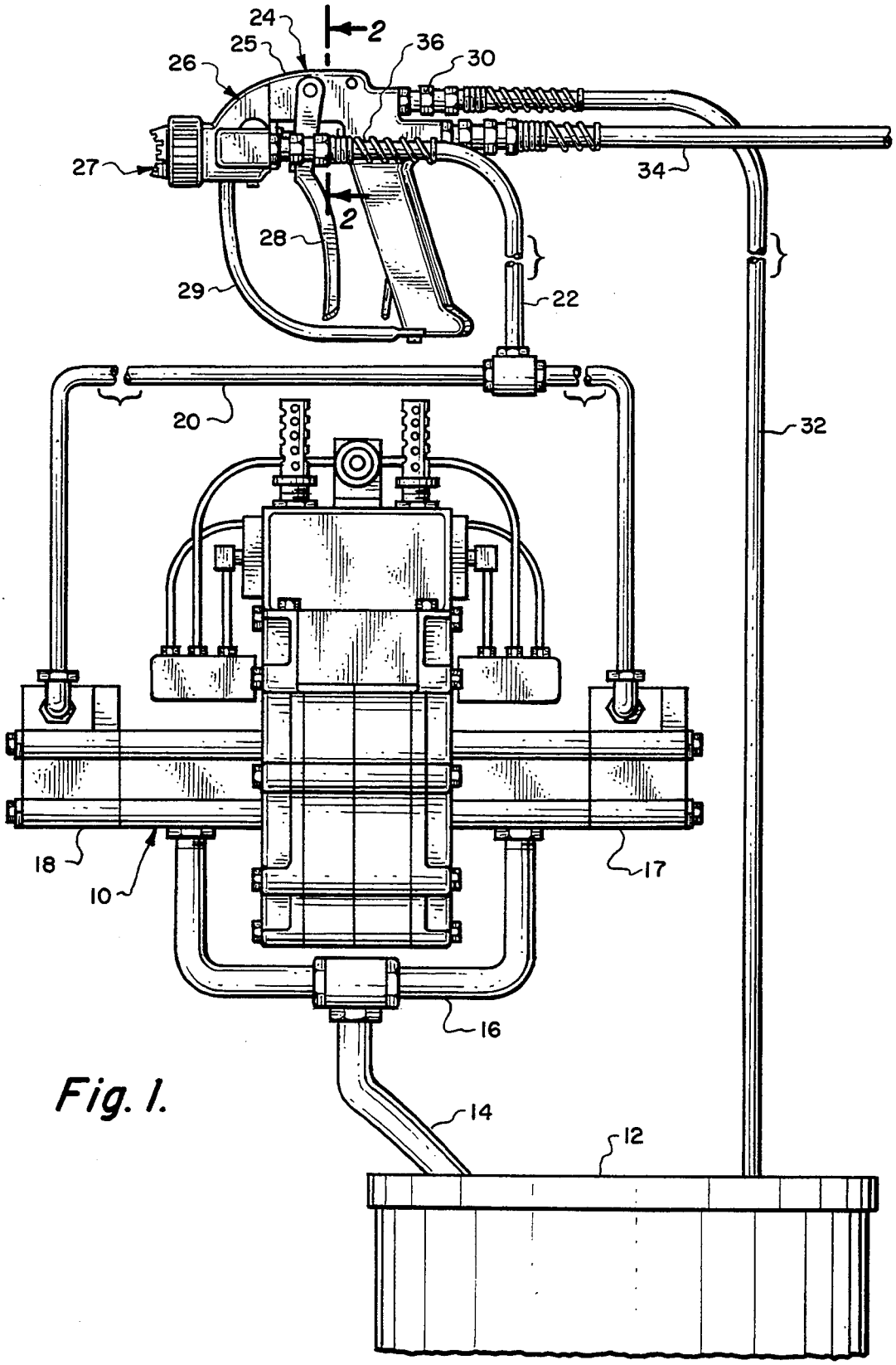
FIG. 1 illustrates a pumping and spraying system according to the invention.

FIG. 1 illustrates a system for spraying heavy filled materials such as heavy granular filled resins for combination with catalysts to be sprayed on a variety of surfaces. Materials such as granite filled gel coat resins to provide a granite effect on a surface are particularly suitable for use with the invention. The system shows a dual action pump 10 connected to reservoir providing a source of heavy filled material through intake 14 and manifold 16. Pumps 17 and 18 of dual action pump 10 deliver material to manifold 20 and hose 22 for spraying by spray gun 24. Nozzle body 26 of spray gun 24 has been designed to accommodate the heavy viscous fluid materials and prevent clogging when trigger 28 of spray gun 24 is operated.

Pump 10 continually pumps material from source 12 through manifold 16 out to manifold 20 and to spray gun 24. Thus material is available to spray tip 27 on demand whenever trigger 28 is operated. Release of trigger 28 diverts the heavy viscous material from reservoir 12 to return outlet 30 for return to the reservoir by return hose 32. When trigger 28 is released pump 10 slows to a bypass mode because of the smaller return line, keeping the heavy filled viscous fluid material circulating from reservoir 12 to gun nozzle body 26 and back to the reservoir. This keeps the fluid ready on demand the instant trigger 28 is operated. This prevents any lead or lag time between primary and secondary fluids and assures the proper flow and mixture with a secondary fluid delivered through coaxial hose 34 as described in the spray gun patent referred to hereinabove.

Figure 2:
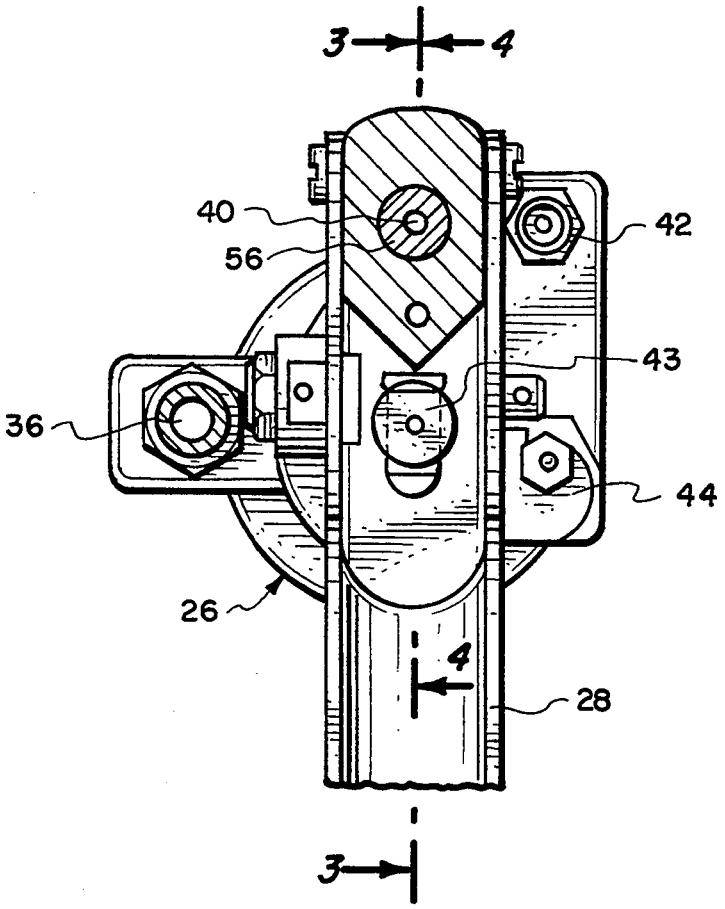
FIG. 2 is a sectional view taken at 2—2 of FIG. 1.

As shown in FIG. 2 nozzle body 26 disclosed and described in U.S. Pat. No. 4,175,702 previously referred to has been remodeled and redesigned to incorporate a more generous primary feed conduit 36 leading to a chamber which will be described in greater detail hereinafter. The heavy viscous material is delivered to the primary feed conduit 36 receiving primary fluid from pump 10 and hose 22 for delivery to nozzle spray tip assembly 27. When trigger 28 is released the flow of the heavy filled viscous material returns through diversion conduit 40 and 41 for return to source reservoir 12 through connector 30 and return hose 32. Spray gun 24 includes fitting 40 for adding regulated air. Trigger 20 operates collets 43 and 44 for releasing primary fluid and air to nozzle body 26 as will be described in greater detail hereinafter.

Figure 4:
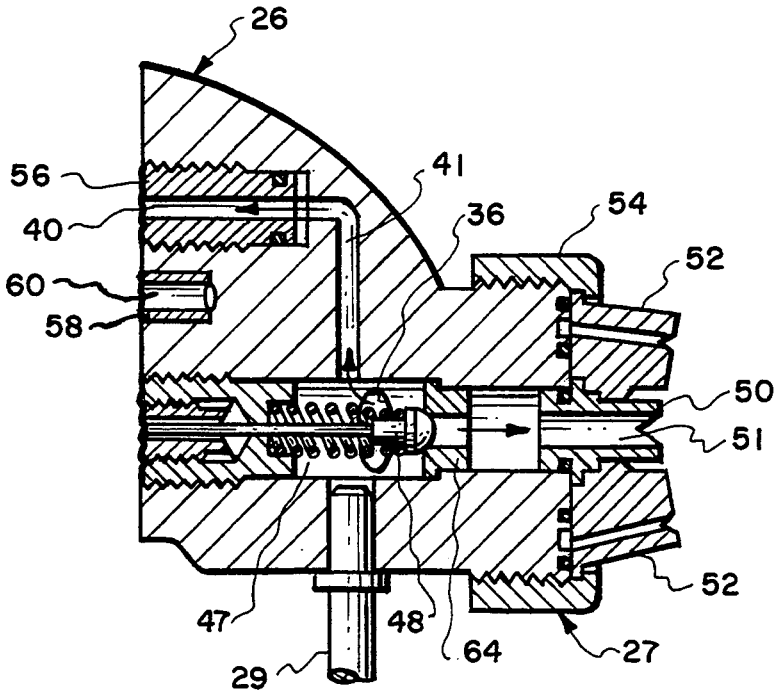
FIG. 4 is a partial sectional side elevation of the spray gun nozzle body taken at 4—4 of FIG. 2.
Figure 3:
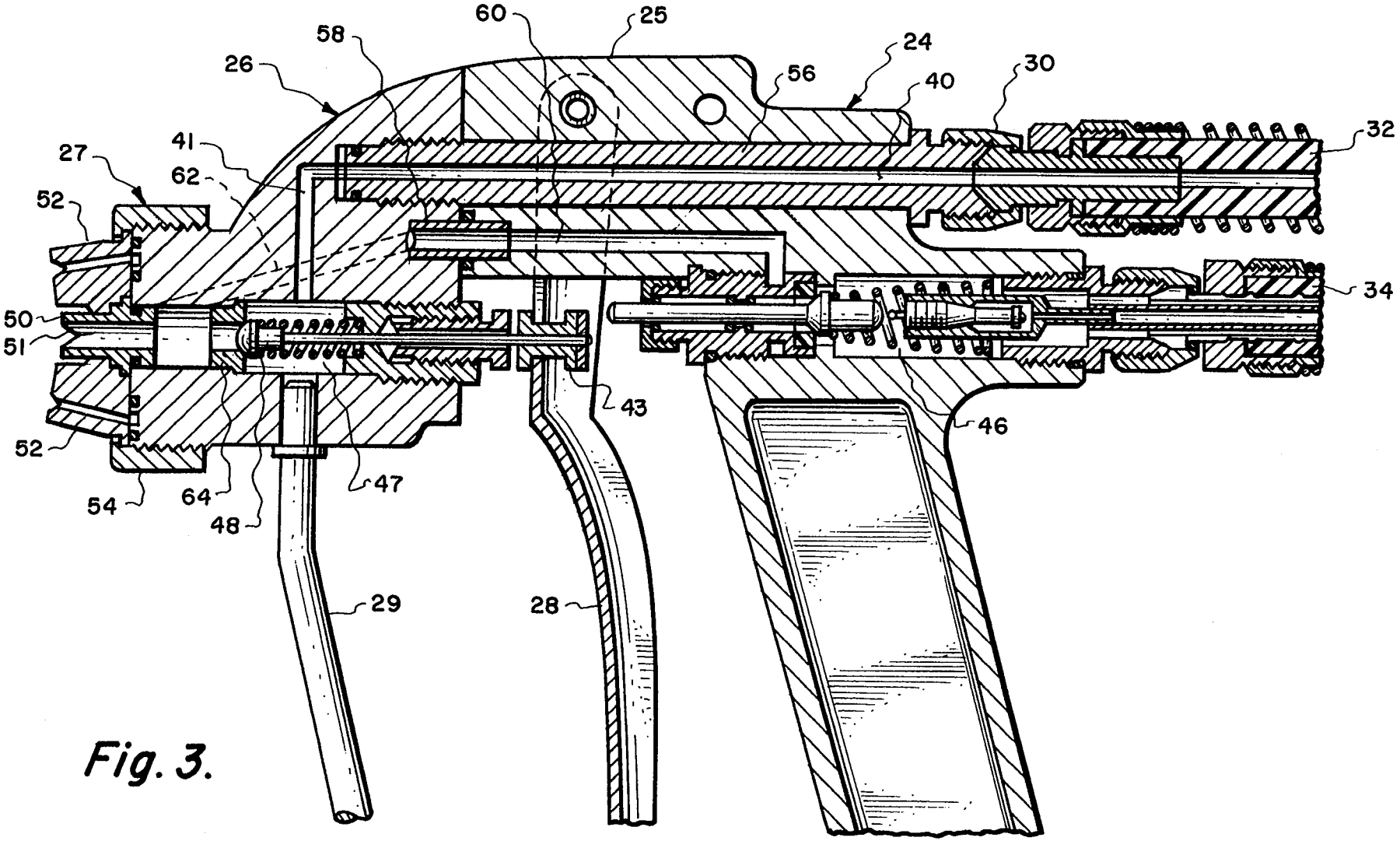
FIG. 3 is a sectional side elevation taken at 3—3 of FIG. 2.

The details of the spray gun handle body 25 and nozzle body 24 are illustrated in greater detail in section side view of FIG. 3 and partial section of FIG. 4. Handle body 25 has trigger 28, trigger guard 29 and cartridge valve catalyst delivery system in chamber 46. The cartridge valve catalyst delivery system in chamber 46, air delivery system and nozzle spray tip 27 are the same as disclosed and described in U.S. Pat. No. 4,123,007 issued in October 1978. Nozzle body 26 has an internal air delivery system incorporated to provide forced air through the primary material delivered through conduit 36 and feed tube 22 to chamber 47 having primary fluid control valve 48. Primary fluid control valve 48 controls the flow of primary heavy viscous fluid material to spray tip assembly 27. Spray tip assembly 27 is comprised of primary fluid tip 50 and secondary fluid nozzles 52 retained on nozzle body 26 by retaining ring 54.

Nozzle body 26 is attached to handle body 25 by return tube 56 and is maintained in alignment by tube 58 sealed by an 0-ring connecting secondary fluid passageway 60 leading from chamber 46 to outlet passages 62 and catalyst nozzles 52. Primary material valve 48 is operated by collet 43 secured to trigger 28 by a lock nut. The flow of the primary material is stopped by primary fluid valve 48 engaging valve seat 64 to stop the flow of the primary material to spray tip nozzle 50.

To prevent the heavy viscous material from "packing-out" and clogging passageway 51 in nozzle tip 50 diversion conduits 40 and 41 divert the heavy viscous material to return tube 56. Return tube 56 and conduits 40 and 41 have a smaller diameter than primary source conduit 36 that intersects chamber 47 at an oblique angle adjacent primary valve 48 as shown in FIG. 4 so that when trigger 28 is operated the primary fluid flowing into chamber 47 is sprayed from primary fluid nozzle tip 50 through passageway 51.

Whenever primary fluid valve 48 is seated on valve seat 64 the flow of the heavy filled viscous material from primary conduit 36 is automatically diverted into diversion conduit 41 perpendicular to chamber 47, back to the source through diversion tube 56 and hose 32. Diversion conduit 41 intersects chamber 47 at a right angle and upstream of primary conduit 36. Diversion conduits 40,41 remain open throughout operation of primary fluid valve 48. With primary fluid valve 48 open fluid flows on demand through passageway 51 in nozzle tip 50 even though smaller diversion conduits 40,41 remain open to chamber 47. Closing primary fluid valve 48 by releasing trigger 28 diverts all the flow of the heavy filled viscous fluid material upstream to diversion conduits 40,41 for return to reservoir 12. This keeps the primary heavy filled viscous fluid material ready for delivery from nozzle tip 50 through passageway 51 on demand without any lead or lag time between primary and secondary fluids that could cause an improper mixture and waste of material.

The primary heavy filled viscous fluid is thus delivered through primary conduit 36 to chamber 47 for delivery to primary fluid nozzle tip 50 having a passageway 51. A secondary fluid such as a catalyst is delivered through coaxial hose 34 for mixing with regulated air in chamber 46 and delivered through passageway 60 to secondary fluid nozzle tips 52. The combination of the primary and secondary fluids from nozzle tip assembly 27 provides a uniform fan shaped pattern that evenly coats a selected surface.

The system operates as follows. With trigger 28 off pump 10 circulates the heavy viscous material from reservoir 12 through manifolds 16 and 20 and hose 22 to primary fluid conduit 36 in nozzle body 26. When trigger 28 is operated primary fluid valve 48 releases the heavy filled viscous fluid from chamber 47 to nozzle tip assembly 27 with boost air from conduit 42 (FIG. 2) for spray in a fan shaped pattern. The heavy viscous primary fluid is combined with a secondary fluid such as a catalyst sprayed from the catalyst nozzles 52. Release of trigger 28 stops the flow of the heavy filled viscous fluid material, air and catalyst to nozzle tip assembly 27. The heavy filled viscous material is then automatically diverted into smaller diversion passageways 40,41 and diversion tube 56 for return to the source reservoir 12 through conduit 32. This keeps the heavy viscous material from "packing-out" or clogging by continuously recirculating from the source or reservoir 12 all the way to near the gun nozzle tip and back to the source. Pump 10 slows down into a bypass mode when trigger 28 is released. Whenever trigger 28 is activated, since pump 10 is already in operation, there is no lag time and the heavy viscous fluid is immediately delivered from primary conduit 36 to fluid tip 28 at the same time as the secondary fluid.

Thus there has been disclosed a pumping system and spray gun for spraying heavy viscous materials which prevents clogging of the spray gun nozzles. With the pump and spray gun of the present invention, a variety of heavy filled fluid materials or other heavy viscous materials can be sprayed.

This invention is not to be limited by the embodiment shown in the drawings and described in the description which is given by way of example and not of limitation, but only in accordance with the scope of the appended claims.

What is claimed is:

1. A system for pumping and sprying a heavy filled viscous fluid comprising;

a source of a heavy filled viscous primary fluid;

pump means for pumping said primary fluid;

spraying means connected to said pump means for spraying said primary fluid, said spraying means comprising;

a spray gun having a fluid nozzle for spraying said primary fluid and a secondary fluid;

first conduit means for delivering said primary fluid to said fluid nozzle;

second conduit means for delivering said secondary fluid to said fluid nozzle;

primary valve means in said first conduit means for releasing said primary fluid to said nozzle;

said first conduit means including a chamber surrounding said primary valve means and a first conduit intersecting said chamber immediately adjacent said primary valve means;

diversion conduit means intersecting said first conduit means near said primary valve means for diverting said primary fluid back to said source of primary fluid when said primary valve means is closed;

said diversion conduit means including a diversion conduit intersecting said chamber a predetermined distance upstream from the intersection of said first conduit;

whereby said primary fluid is delivered to said fluid nozzle when said primary valve means is open and when said primary valve means is closed said primary fluid is diverted into said diversion conduit means for recirculation back to said source.

2. The system according to claim 1 in which said diversion conduit is smaller in diameter than said first conduit.

3. The system according to claim 2 in which said diversion conduit intersecting said chamber is substantially perpendicular to an axis of said chamber.

4. A plural component spray gun for spraying heavy filled viscous fluid comprising;

a source for supplying a heavy filled viscous primary fluid;

a fluid nozzle for spraying said primary fluid and a secondary fluid;

first conduit means for delivering said primary fluid to said fluid nozzle;

second conduit means for delivering said secondary fluid to said fluid nozzle;

primary valve means in said first conduit means for delivering said primary fluid to said fluid nozzle;

said first conduit means including a chamber surrounding said primary valve means and a first conduit intersecting said chamber immediately adjacent said primary valve means;

diversion conduit means intersecting said first conduit means for diverting said primary fluid;

said diversion conduit means intersecting said chamber upstream from said first conduit;

whereby when said primary valve means is open said primary fluid is delivered to said fluid nozzle and when said primary valve means is closed said primary fluid is diverted into said diversion conduit means for recirculation back to said source.

5. The spray gun according to claim 4 in which said diversion conduit means is smaller in diameter than said first conduit.

6. The spray gun according to claim 5 in which said diversion conduit means intersecting said chamber is substantially perpendicular to an axis of said chamber.

7. A system for pumping and spraying a heavy filled viscous fluid comprising;

a source of a heavy filled viscous fluid;

pump means for pumping said viscous fluid;

spraying means connected to said pump means for spraying said viscous fluid, said spraying means comprising;

a spray gun having a fluid nozzle for spraying said viscous fluid;

a chamber in said spray gun for receiving said viscous fluid;

a first conduit for delivering said viscous fluid to said chamber in said spray gun;

primary valve means in said chamber for releasing said viscous fluid to said nozzle;

second conduit means intersecting said chamber near said primary valve means for diverting said viscous fluid back to said source of viscous fluid when said primary valve means is closed;

said second conduit means including substantially preventing diversion of said viscous fluid when said primary valve means is open;

whereby substantially all said viscous fluid is delivered to said fluid nozzle when said primary valve means is open and said viscous fluid is diverted into said second conduit means for recirculation back to said source when said primary valve means is closed.

8. The system according to claim 7 in which said diversion preventing means comprises said second conduit means being smaller in diameter than said first conduit.

9. The system according to claim 8 in which said diversion preventing means further comprises said second conduit means intersecting said chamber upstream from said first conduit.

10. The system according to claim 9 in which said first conduit intersects said chamber at an oblique angle substantially adjacent to said primary valve means.

11. The system according to claim 10 in which said second conduit means intersects said chamber substantially perpendicular to an axis of said chamber.

12. The system according to claim 11 including a third conduit means for delivering a secondary fluid to said fluid nozzle for mixing with said viscous fluid; whereby the proportion of secondary fluid to said viscous fluid may be maintained.

13. The system according to claim 7 in which said diversion preventing means comprises said second conduit means intersecting said chamber upstream from said first conduit.

14. The system according to claim 13 in which said first conduit intersects said chamber at an oblique angle substantially adjacent to said primary valve means.

15. The system according to claim 14 in which said second conduit means intersects said chamber substantially perpendicular to an axis of said chamber.

16. The system according to claim 15 including a third conduit means for delivering a secondary fluid to said fluid nozzle for mixing with said viscous fluid; whereby the proportion of secondary fluid to said viscous fluid may be maintained.

17. The system according to claim 7 including a third conduit means for delivering a secondary fluid to said fluid nozzle for mixing with said viscous fluid; whereby the proportion of secondary fluid to said viscous fluid may be maintained.

18. A plural component spray gun for spraying heavy filled viscous fluid comprising;

a fluid nozzle for spraying a viscous fluid delivered to said spray gun;

a chamber in said spray gun for receiving said viscous fluid;

a first conduit for delivering said viscous fluid to said chamber in said spray gun;

primary valve means in said chamber for delivering said viscous fluid to said fluid nozzle;

second conduit means intersecting said chamber for diverting said viscous fluid back to a source;

said second conduit means including diversion preventing means for substantially preventing diversion of said viscous fluid when said primary valve means is open;

whereby when primary valve means is open said viscous fluid is delivered to said fluid nozzle and when said primary valve means is closed said viscous fluid is diverted into said second conduit means for recirculation back to said source.

19. The spray gun according to claim 18 in which said diversion preventing means comprises said second conduit means being smaller in diameter than said first conduit.

20. The spray gun according to claim 19 in which said diversion preventing means further comprises said second conduit means intersecting said chamber upstream from said first conduit.

21. The spray gun according to claim 20 in which said first conduit intersects said chamber at an oblique angle substantially adjacent to said primary valve means.

22. The spray gun according to claim 21 in which said second conduit means intersects said chamber substantially perpendicular to an axis of said chamber.

23. The spray gun according to claim 22 including a third conduit means for delivering a secondary fluid to said fluid nozzle for mixing with said viscous fluid; whereby the proportion of secondary fluid to said viscous fluid may be maintained.

24. The spray gun according to claim 18 in which said diversion preventing means comprises said second conduit means intersecting said chamber upstream from said first conduit.

25. The spray gun according to claim 24 in which said first conduit intersects said chamber at an oblique angle substantially adjacent to said primary valve means.

26. The spray gun according to claim 25 in which said second conduit means intersects said chamber substantially perpendicular to an axis of said chamber.

27. The spray gun according to claim 26 including a third conduit means for delivering a secondary fluid to said fluid nozzle for mixing with said viscous fluid; whereby the proportion of secondary fluid to said viscous fluid may be maintained.

28. The spray gun according to claim 18 including a third conduit means for delivering a secondary fluid to said fluid nozzle for mixing with said viscous fluid; whereby the proportion of secondary fluid to said viscous fluid may be maintained.

* * * * *

UNITED STATES PATENT AND TRADEMARK OFFICE

CERTIFICATE OF CORRECTION

PATENT NO. : 5,351,887

DATED : October 4, 1994

INVENTOR(S) : Hetherington

It is certified that error appears in the above-indentified patent and that said Letters Patent is hereby corrected as shown below:

On the title page, under item [19] and item [75], change "Heterington" to --Hetherington--;

Column 6, line 10, Claim 1, change "sprying" to --spraying--.

Signed and Sealed this

Twenty-seventh Day of December, 1994

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,351,887

DATED : October 4, 1994

INVENTOR(S) : Robert D. Hetherington

It is certified that error appears in the above-identified patent and that said Letters Patent is hereby corrected as shown below:

Claim 7, Column 7, Line 30 after "including" insert

-- diversion preventing means for --.

Signed and Sealed this

Sixth Day of June, 1995

Bruce Lehman

*Attest:*

BRUCE LEHMAN

*Attesting Officer*

*Commissioner of Patents and Trademarks*